US005836196A

United States Patent [19]

Smith

[11] Patent Number: 5,836,196

[45] Date of Patent: Nov. 17, 1998

[54] DEVICE FOR FORMING ROOFING TILES

[76] Inventor: Lance D. Smith, P.O. Box 53, Monroe, Wash. 98272

[21] Appl. No.: 811,835

[22] Filed: Mar. 5, 1997

[51] Int. Cl.[6] ..... B21D 9/05; B21J 13/02

[52] U.S. Cl. ..... 72/384; 72/389.1; 72/389.6; 72/455

[58] Field of Search ..... 72/389.1, 389.2, 72/389.3, 389.6, 389.8, 389.9, 455, 472, 384; 100/214, 257

[56] References Cited

U.S. PATENT DOCUMENTS

| | | | |
|---|---|---|---|
| 905,909 | 12/1908 | McSherry . | |
| 2,023,638 | 12/1935 | Lawson . | |
| 2,422,952 | 6/1947 | Dakin . | |
| 3,087,242 | 4/1963 | Bohn . | |
| 3,301,035 | 1/1967 | Gill | 100/214 |
| 3,877,279 | 4/1975 | Van Cleave | 72/319 |
| 3,902,350 | 9/1975 | McManus . | |
| 4,242,903 | 1/1981 | Ledford et al. | 72/413 |
| 4,509,357 | 4/1985 | Zbornik | 72/384 |
| 4,574,611 | 3/1986 | Hegemann | 72/389.3 |
| 4,852,379 | 8/1989 | Levenberg | 72/472 |

*Primary Examiner*—David Jones
*Attorney, Agent, or Firm*—Jensen & Puntigam, P.S.

[57] ABSTRACT

A portable machine for on the job forming of pre-countered metal roofing tile wherein the pre-contour may be selectively flattened for accurate cutting or bent to accommodate ridges or valleys.

2 Claims, 4 Drawing Sheets

FIG. 3
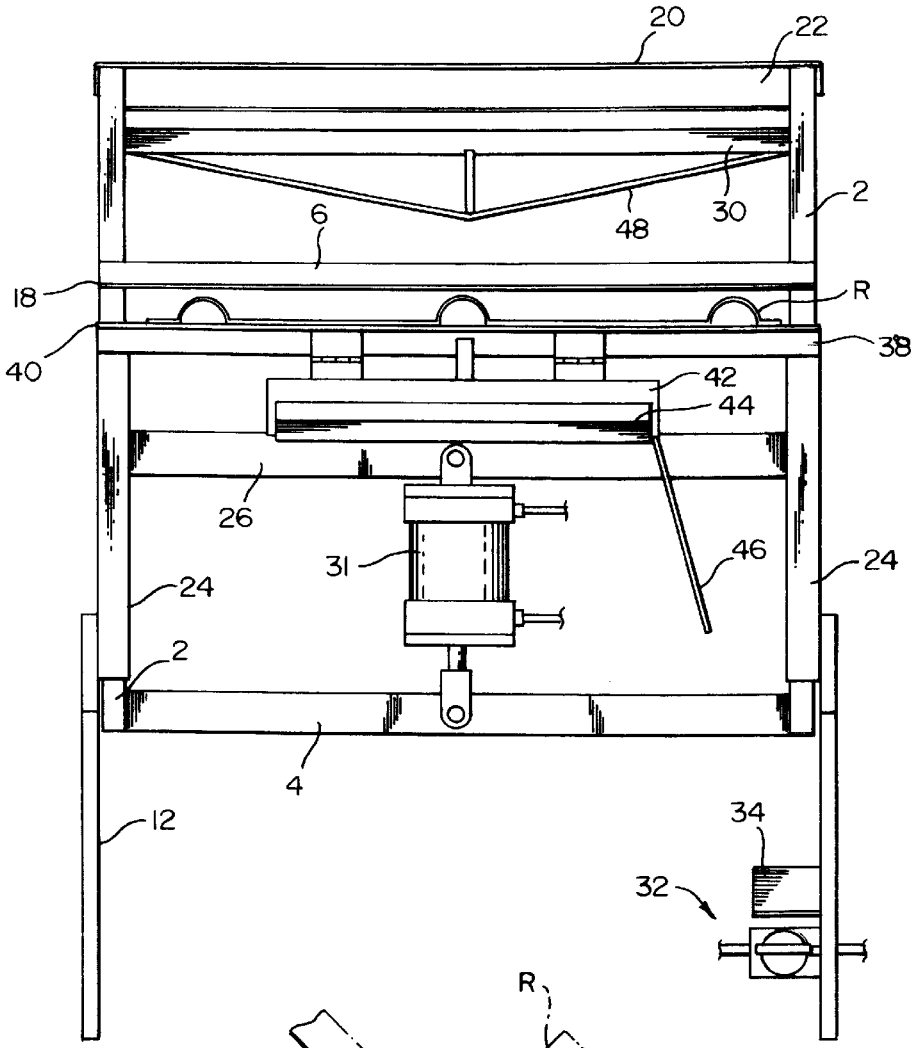
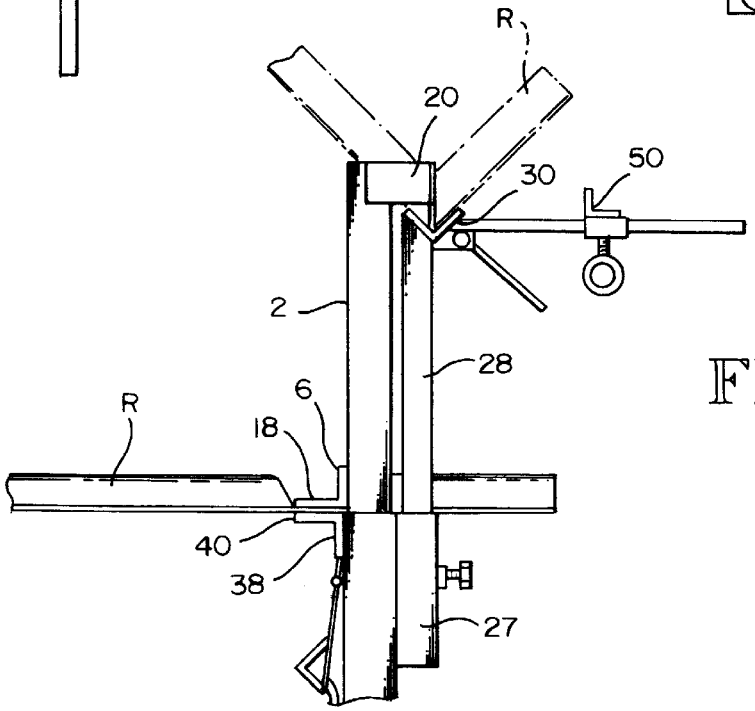
FIG. 4

DEVICE FOR FORMING ROOFING TILES

TECHNICAL FIELD

This invention relates to a portable machine for selectively forming sheets of preformed metal roofing tiles, wherein the sheets include preformed corrugations, and more particularly, to a machine for flattening the corrugations of preformed metal roofing sheets in preparation for cutting the tiles to size as well as bending the sheets to accommodate peaks and valleys in the roof at the job sight.

BACKGROUND OF THE INVENTION

Because of the increasing cost of materials and labor, manufacturers have endeavored to supply roofing materials which are both durable and attractive, and further are relatively inexpensive and capable of being applied with a minimum of labor. To this end, roofing is now often supplied in large metallic sheets which may be preformed at the factory to imitate the appearance of more traditional roofing, such as shake shingles and/or a tile roof. These changes in material and labor have reduced the overall cost of maintaining a roof.

Although these new materials are very effective and are gaining in popularity because of their durability and cost, an ongoing problem exists in the actual application, in that rarely do the sheets come in sizes such that they do not need to be cut or formed to apply to a particular roof.

The preformed sheets, although attractive because of their inherent configuration to imitate the more traditional roofing, are difficult to cut to size accurately because of the preformed configurations, or to bend quickly and accurately to accommodate a peak or a valley. It is imperative that a seam not be located at a peak or valley.

Prior art devices known to the inventor for forming metal include U.S. Pat. No. 905,909 granted to McSherry, Dec. 8, 1908, which discloses a manual machine including several shearing, bending or punching stations which are operated simultaneously by the same handle.

U.S. Pat. No. 2,023,638 granted to Lawson, Dec. 10, 1935, discloses an apparatus for producing sharp corners in metal stock.

U.S. Pat. No. 2,422,952 granted to Dakin, Jun. 24, 1947, discloses a metal press mechanism which forms, trims and punches in one operation of the die press.

U.S. Pat. No. 3,087,242 granted to Bohn, Apr. 30, 1963, discloses a hand tool capable of punching, shearing, bending or twisting flat metal stock.

U.S. Pat. No. 3,902,350 granted to McManus, Sep. 2, 1975, discloses a tool having a pair of spaced arms to receive the material and form it about a curved bar apex.

DISCLOSURE OF THE INVENTION

With the above-noted prior art in mind, it is an object of the present invention to provide a single hydraulic or pneumatic device which will press out preformed configurations in a sheet of roofing metal, enabling same to be cut more quickly and easily, or alternatively to bend the metal.

Another object of the present invention is to provide a portable, simple and inexpensive mechanism for forming or bending sheet metal roofing.

Still another object of the present invention is to provide a device having more than one station, enabling an operator to perform more than one operation on a piece of sheet metal roofing.

It is yet another object of the present invention to provide a mechanism which is inexpensive and simple to use and substantially reduces the total time involved in applying preformed metal roofing.

BRIEF DESCRIPTION OF THE DRAWINGS

FIG. 3 is a front elevational view of the present invention.

FIG. 4 is a side elevational view of the upper portion of the device, showing sheet metal roofing being formed.

BEST MODE FOR CARRYING OUT THE INVENTION

Figure 1:
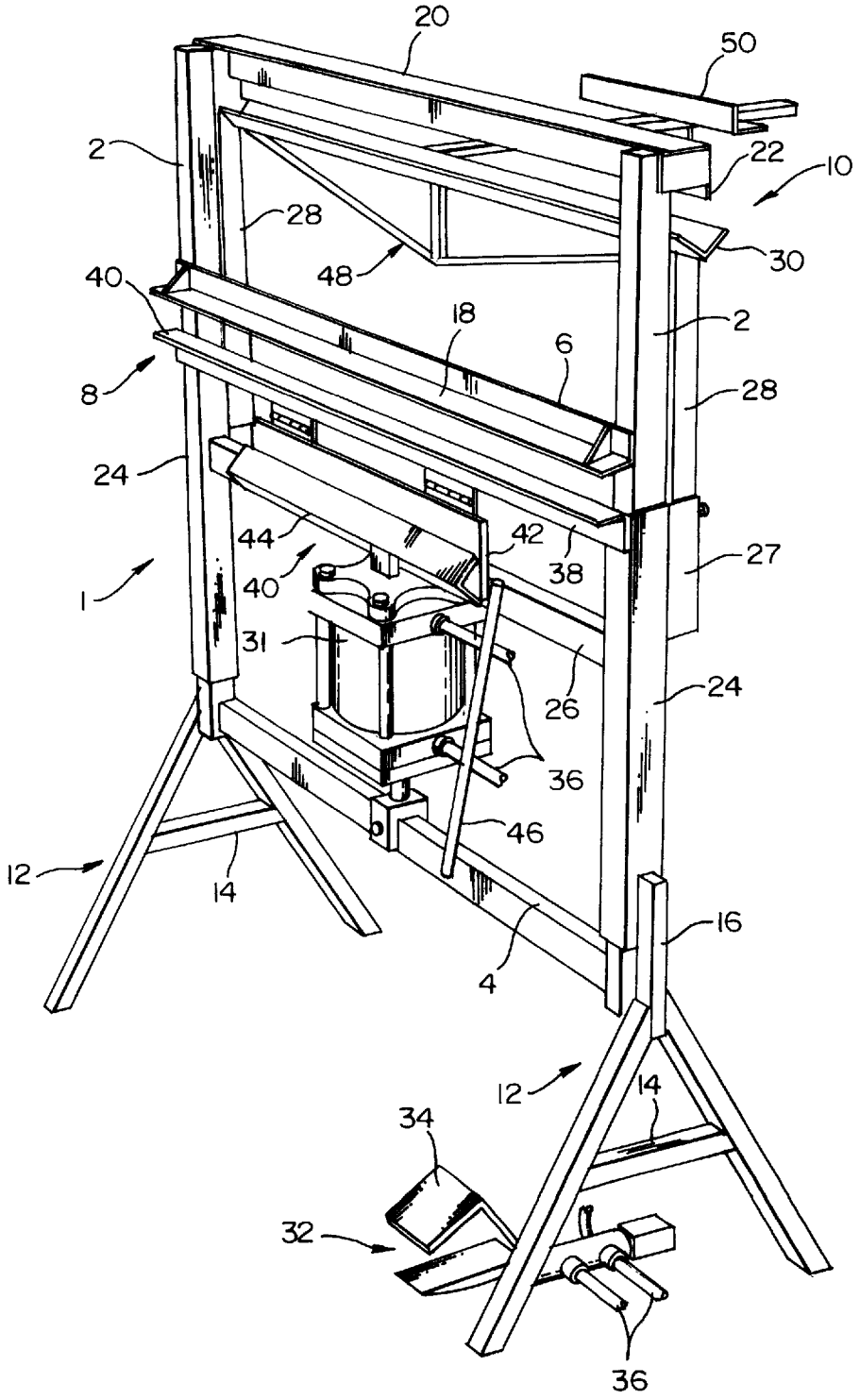
FIG. 1 is an isometric view of the inventive metal forming device.

As seen in FIG. 1, the inventive device comprises a substantially vertical main frame 1, including a pair of parallel, vertically movable, rectangular upright members 2 joined by at least a pair of horizontal members 4, 6, and captured in a telescopic manner in a pair of vertical sleeves 24. The upper portion of the machine includes, in the preferred embodiment, a first flattening station 8, as explained in greater detail hereinafter, and a second bending station 10, again as explained in greater detail hereinafter.

As can be seen, the entire framework is supported on a pair of opposing triangular legs 12 reinforced by crossbar 14 secured to vertical member 16 which is rigidly secured to hollow frame members 24 at the bottom thereof, permitting the vertical movement of captured upright members 2. Fixed to the frame members 2 is crosspiece 6, which includes as an integral part thereof a horizontal anvil 18 and vertically above the crosspiece 6 and anvil 18 is another crossmember 20, including a downwardly extending vertical plate or forming member 22. The sleeves 24 which capture vertical elements 2 for vertical reciprocal movement therein have as an integral part thereof a crosspiece 26, a laterally offset, vertical extension 28, terminating in a reinforced V-shaped channel member 30, which extends between the upper ends of extension member 28, forming a rigid moving rectangle. Mounted between the movable horizontal member 4 secured to the vertical members 2 and crosspiece 26 extending between the vertical sleeve frame members 24 is a pneumatic ram 31 controlled by a foot control 32, including a rigid safety shield 34.

Control 32 is interconnected with the ram 30 by means of flexible conduits 36. Mounted above crosspiece 26 for interaction with the anvil 18 is yet another crosspiece 38 in the form of an angle iron, wherein the horizontal element 40 interacts with anvil 18 such that a piece of preformed roofing placed between the two elements 18 and 40 upon activation of the control switch 32, which moves the slide assembly including the telescopic elements 22, crosspieces 4, 18 and 20 downwardly, compressing the roofing between the members 18 and 40 and removing any of the preformed configuration, preparing the roofing for accurate cutting. (See FIG. 5.)

Hingedly mounted to the bottom of angle iron 38 is a bending element 40, including a plate 42 and a reinforcing angle element 44 and a handle member 46, such that a piece of roofing which is captured between elements 18 and 40 may be bent upwardly by upward movement of the handle 46, forcing the reinforcing angle element 44 to cause the roofing piece to be bent upwardly.

Extension members 28 are removably secured in sleeves 27 which are rigidly secured to sleeves 24. Members 28 include at their upper portion an angle member 30, as previously stated. Angle member 30 at the upper portion of extensions 28 includes a triangular reinforcing element 48. A piece of roofing material of a predetermined width defined by adjustable guide element 50 is placed between the vertical element 22 and the angle element 30, and upon activation of the pneumatic cylinder 31 is compressed between the two and formed into an angle for use upon a peak or in a valley of the roof.

Figure 2:
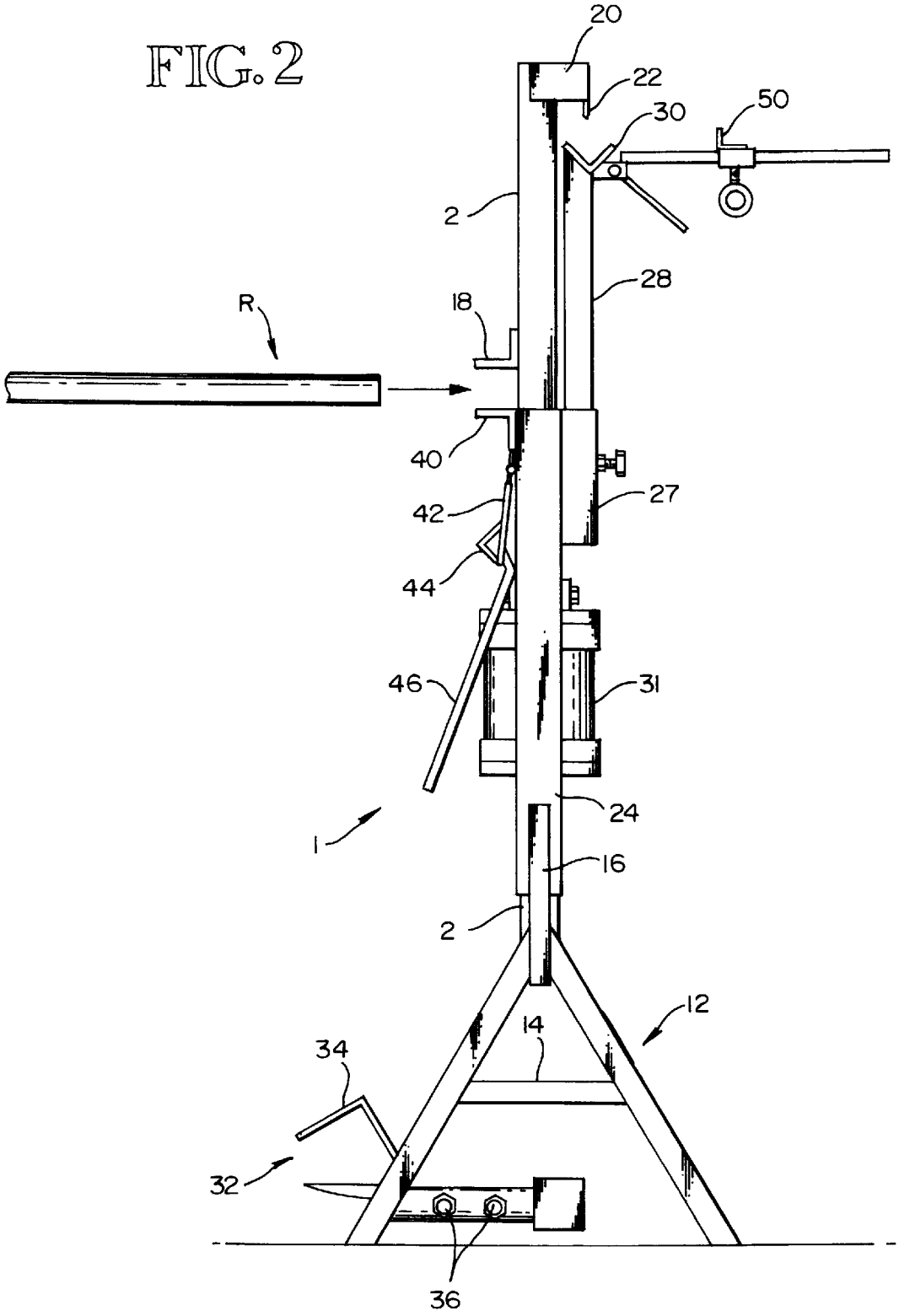
FIG. 2 is a side elevational view of the invention of FIG. 1.

As perhaps best seen in FIG. 2, when the pneumatic ram 31 is activated by switch 32, rectangular framework 2 and its attached elements 18 and 20 move downwardly, flattening the piece of roofing between elements 18 and 40 and bending the roofing between elements 22 and 30. This is also illustrated in FIG. 4.

FIG. 3 discloses the current invention in its open, roofing-receiving condition, and in fact, a piece of roofing R is shown between the two compressing elements 18 and 40 as an illustration, the compressing elements are in their open position.

Figure 5:
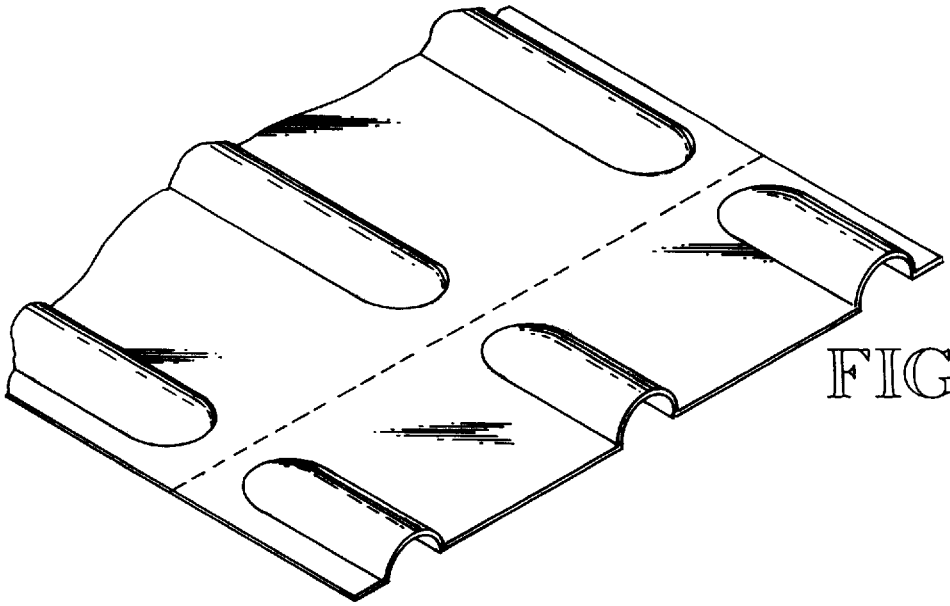
FIG. 5 is a view of the preformed sheet metal after preparing it for cutting, showing the flattened portion.
Figure 6:
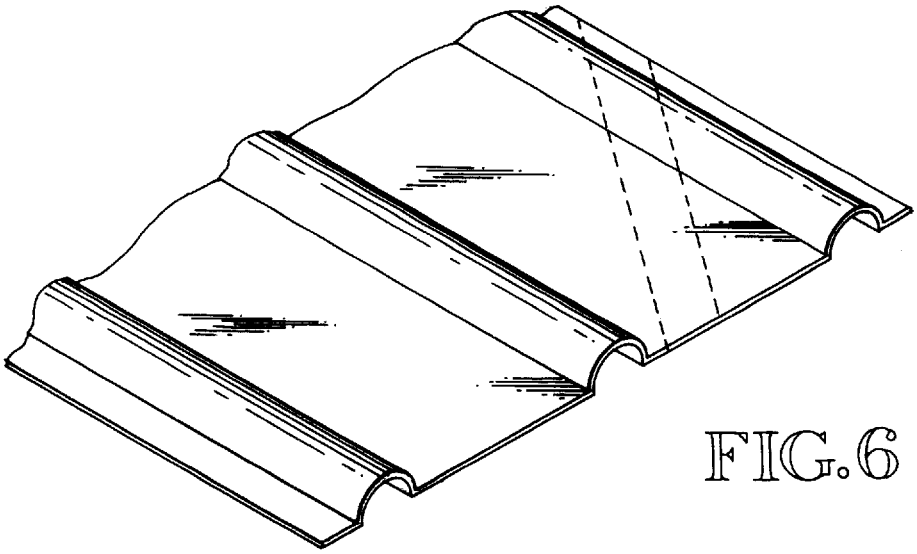
FIG. 6 is an illustration of the sheet metal roofing showing an alternate configuration for the flattening or bending.

As seen in FIG. 5, a piece of preformed roofing R has been compressed, leaving a flat surface for ease in cutting the material. Likewise seen in FIG. 6, the present invention can be used at an angle such as would be used when a dormer, garage or other wing extends outwardly from the main roof in a perpendicular direction creating a valley where the roofs join.

Thus, as can be seen, the present invention discloses a simple, relatively inexpensive portable machine for quickly and easily performing any one of several operations upon a sheet of preformed roofing, thus substantially saving in work time and therefore the cost associated with applying a roof.

I claim:

1. A portable machine including at least two discrete work stations for performing a plurality of operations upon a sheet of preformed roofing without the necessity of altering the machine, comprising;

a generally vertical rectangular main frame supported by stabilizing feet, including at least one fixed horizontal member extending between the sides of the main frame and located intermediate the ends thereof;

a vertically reciprocal rectangular working element captured within the main frame;

means to selectively reciprocate the working element;

a first work station comprising flattening means cooperating with a fixed horizontal member of the main frame and a horizontal member of the working element to flatten a defined strip of the preformed roofing when the two members reciprocate together; and a second work station vertically spaced from the first work station comprising bending means cooperating with a fixed horizontal member of the main frame, said bending means secured to the working element and reciprocating therewith, enabling an operator to bend a portion of the roofing, whereby a worker may perform substantially all of the operations necessary for installing preformed sheet roofing on the machine.

2. A portable machine as in claim 1, wherein means are provided to bend roofing while secured at the first work station.

* * * * *